US006950027B2

(12) United States Patent
Banas

(10) Patent No.: US 6,950,027 B2
(45) **Date of Patent: *Sep. 27, 2005**

(54) METHOD TO ALERT DROWSY DRIVER

(75) Inventor: Patrick A. Banas, Sterling Heights, MI (US)

(73) Assignee: Siemens VDO Automotive Corporation, Auburn Hills, NJ (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 925 days.

This patent is subject to a terminal disclaimer.

(21) Appl. No.: 09/772,274

(22) Filed: Jan. 29, 2001

(65) Prior Publication Data

US 2002/0101354 A1 Aug. 1, 2002

Related U.S. Application Data

(60) Provisional application No. 60/227,411, filed on Aug. 23, 2000.

(51) Int. Cl.[7] ..... G08B 23/00

(52) U.S. Cl. ..... 340/576; 340/425.5; 340/575; 180/271

(58) Field of Search ..... 340/425.5, 575, 340/576; 180/271, 272, 281

(56) References Cited

U.S. PATENT DOCUMENTS

| | | | | | |
|---|---|---|---|---|---|
| 4,928,090 | A | * | 5/1990 | Yoshimi et al. | 340/575 |
| 5,259,553 | A | * | 11/1993 | Shyu | 236/49.3 |
| 5,488,353 | A | * | 1/1996 | Kawakami et al. | 340/576 |
| 5,518,176 | A | * | 5/1996 | Turner et al. | 236/49.3 |
| 5,585,785 | A | * | 12/1996 | Gwin et al. | 340/575 |
| 5,689,241 | A | * | 11/1997 | Clarke, Sr. et al. | 340/575 |
| 5,813,989 | A | * | 9/1998 | Saitoh et al. | 600/484 |
| 5,910,773 | A | * | 6/1999 | Brownlee | 340/576 |
| 6,034,606 | A | * | 3/2000 | Brownlee | 340/576 |
| 6,060,989 | A | * | 5/2000 | Gehlot | 340/576 |
| 6,072,398 | A | * | 6/2000 | Hayes et al. | 340/632 |
| 6,097,295 | A | * | 8/2000 | Griesinger et al. | 340/57 |
| 6,191,694 | B1 | * | 2/2001 | Brownlee | 340/576 |

* cited by examiner

*Primary Examiner*—Phung T. Nguyen

(57) ABSTRACT

A method for awakening a drowsy driver includes monitoring the drowsiness level of the driver and alerting the driver. The driver is alerted by regulating the temperature in the vehicle interior, releasing oxygen in the vehicle interior, and adjusting the positioning of a window and/or sunroof to vent fresh cooler air into the vehicle. The window and/or sunroof are opened proportionally to the drowsiness level of the driver. The wind entering the vehicle also creates an audible alert which assists in awakening the driver.

5 Claims, 1 Drawing Sheet

METHOD TO ALERT DROWSY DRIVER

This application claims priority from provisional application Ser. No. 60/227,411 filed Aug. 23, 2000.

BACKGROUND OF THE INVENTION

The present invention relates generally to an improved method for alerting a drowsy driver.

A driver may become inattentive during driving due to fatigue or due to the monotony of operating a vehicle for an extended period of time. If a driver becomes inattentive or drowsy during vehicle operation, the likelihood of an accident increases, creating a hazard both to the driver and to surrounding vehicles.

Several methods have been utilized to detect if a vehicle operator is drowsy or unaware. Driver awareness has been monitored by a detector which measures the rate of eye blink or the frequency of brain alpha waves. A decrease in these rates indicates drowsiness or inattentiveness.

Additionally, the movement of the steering wheel or the movement of the driver can be monitored and measured to determine if a vehicle operator is unaware or drowsy. As a vehicle operates, the steering wheel is usually moved slightly, even if the vehicle is being operated on a straight path. The lack of any movement of the steering wheel can be an indicator of a drowsy driver.

After making the determination that a driver is drowsy or unaware, several prior methods have been utilized to alert and awaken the driver. The prior methods include utilizing sound to alert the driver. Noise is created by employing a tone or a buzzer, or by increasing the volume on an audio system.

Hence, there is a need in the art for an improved method for alerting a drowsy driver.

SUMMARY OF THE INVENTION

The present invention relates generally to a method for alerting a drowsy driver by change the quality of the air in the vehicle cab.

A driver may become inattentive during driving due to fatigue or due to the monotony of operating a vehicle for an extended period of time, increasing the likelihood of an accident. The present invention is a method to awaken and alert a driver who has been determined to be drowsy or unaware.

In a first embodiment of the present invention, the temperature of the climate control system of the vehicle is regulated to awaken a driver who is determined to be drowsy or unalert. When this determination is made, a regulator adjusts the climate control system in the vehicle to lower the temperature of the air in the interior space of the vehicle.

In another embodiment of the present invention, oxygen is released through the climate control system to awaken or alert a drowsy driver. The regulator adjusts the climate control system to pump more oxygen into the interior space of the vehicle.

In another embodiment of the present invention, a window and/or sunroof is opened. The regulator opens the window and/or sunroof to allow fresh air to vent into the interior space of the vehicle. The window and/or sunroof is opened by an amount that changes as the drowsiness level changes. Additionally, the wind entering the vehicle creates an audible alert assisting in awakening the driver.

Accordingly, the present invention provides a method for alerting a drowsy driver.

These and other features of the present invention will be best understood from the following specification and drawings.

BRIEF DESCRIPTION OF THE DRAWINGS

The various features and advantages of the invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

A driver may become inattentive during driving due to fatigue or due to the monotony of operating a vehicle for an extended period of time. If a driver becomes inattentive or drowsy during vehicle operation, the likelihood of an accident increases, creating a hazard both to the driver and to surrounding vehicles.

Figure 1:
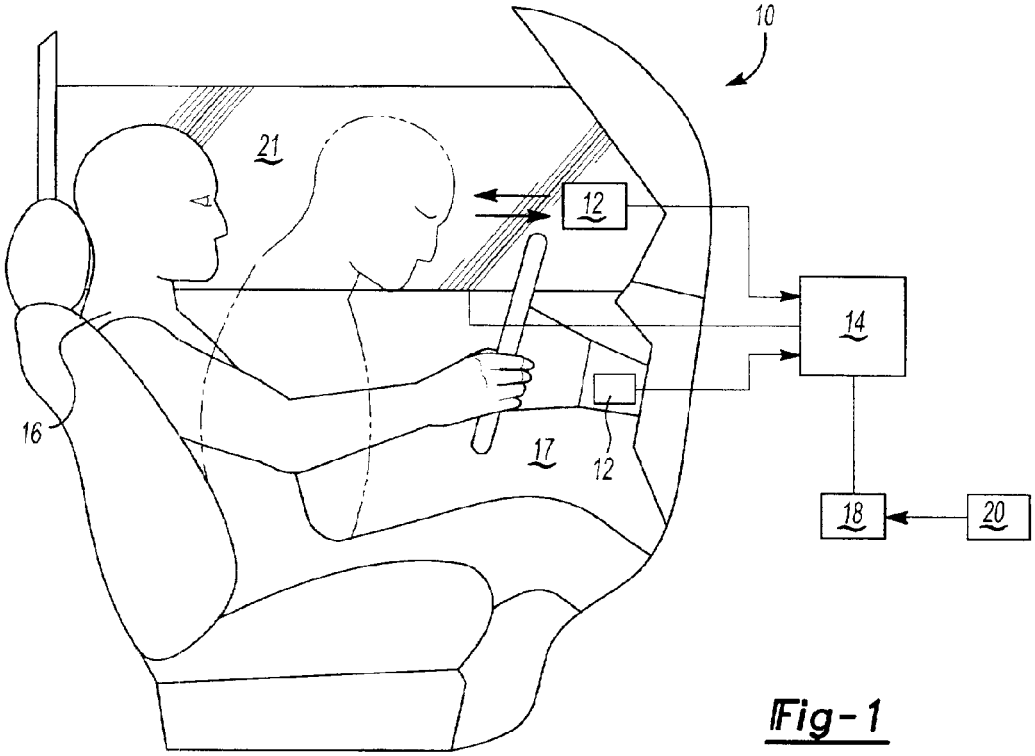
FIG. 1 illustrates a schematic view of a system for keeping a drowsy driver alert.

As illustrated in FIG. 1, a system 10 for keeping a drowsy driver alert includes a sensor(s) 12 and a regulator 14. The sensor 12 monitors a level of drowsiness of the driver 16. As is known, the level of drowsiness can be monitored by measuring the rate of eye blink, the frequency of brain alpha waves, or the movement of the steering wheel or the movement of the driver. This aspect of the invention is known and forms no portion of this invention.

A decrease in the rate of eye blink or the activity of the brain alpha waves is an indication of drowsiness. As a person tires, brain activity decreases, decreasing the activity of brain alpha waves. Additionally, a reduction in the movement of the steering wheel or the movement of the driver can also be an indication of drowsiness or inattentiveness. As a vehicle operates, the steering wheel is usually moved slightly, even if the vehicle is being operated on a straight path.

Figure 2:
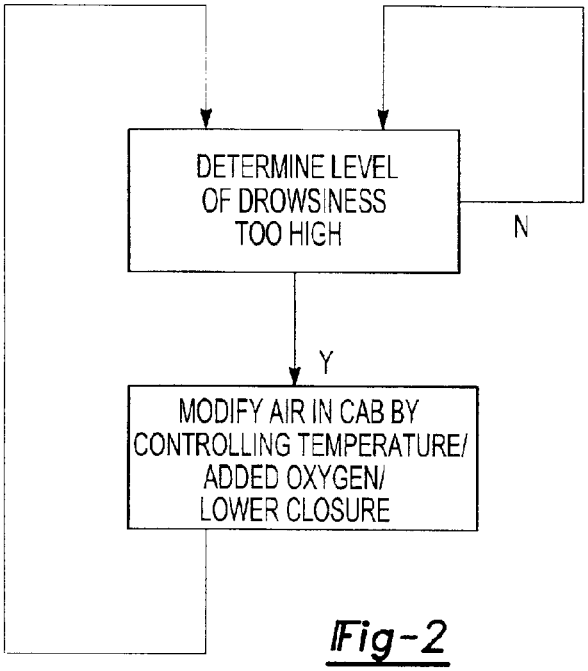
FIG. 2 illustrates a flowchart of the invention.

The present invention provides a method for keeping a drowsy driver alert. When the sensor 12 detects the driver is drowsy or unalert by monitoring a level of drowsiness, the regulator 14 adjusts a vehicle component to awaken or alert the driver. The method is shown by the flowchart of FIG. 2.

In a first embodiment of the present invention, the climate control system 18 of a vehicle is regulated to adjust the temperature in the vehicle cab 17. Drivers are more alert at lower temperatures. When the sensor 12 detects that a driver is drowsy or unalert, the sensor 12 alerts the regulator 14, which adjusts the climate control system 18 in the vehicle, lowering the temperature and awakening the driver.

In another embodiment of the present invention, oxygen from a source 20 is released through the climate control system 18 of the vehicle. Drivers are more alert when they breathe air containing a higher concentration of oxygen. When the sensor 12 determines that a driver is drowsy or unalert by monitoring the level of drowsiness, the regulator 14 alerts the climate control system 18 which pumps oxygen into the vehicle cab 17.

In another embodiment of the present invention, the regulator 14 opens a window and/or sunroof 21 in the vehicle when the sensor 12 detects a high level of drowsiness. When the window and/or sunroof is opened, fresh cooler air flows into the vehicle cab 17 of the vehicle, awakening the driver.

The windows and/or sunroof of the vehicle can be opened at a greater amount as the level of drowsiness increases. If the driver is determined to be only slightly drowsy, the windows and/or sunroof are opened a small amount. However, if the driver is determined to be more drowsy, the windows and/or sunroof are opened a greater amount.

Additionally, noise accompanies the fresh air which enters the vehicle, creating an audible alert which also assists in awakening the driver. The several ways to modify the quality of the air in the cab can each be utilized separately or in any combination.

The foregoing description is only exemplary of the principles of the invention. Many modifications and variations of the present invention are possible in light of the above teachings. The preferred embodiments of this invention have been disclosed, however, so that one of ordinary skill in the art would recognize that certain modifications would come within the scope of this invention. It is, therefore, to be understood that within the scope of the appended claims, the invention may be practiced otherwise than as specially described. For that reason the following claims should be studied to determine the true scope and content of this invention.

What is claimed is:

1. A method to alert a driver comprising the steps of:

monitoring a level of drowsiness; and adjusting a degree of opening of a vehicle aperture an amount that increases as said level of drowsiness increases.

2. The method as recited in claim 1 wherein said vehicle aperture is a window.

3. The method as recited in claim 1 wherein said vehicle aperture is a sunroof.

4. The method as recited in claim 1 wherein the step of adjusting said degree of opening of said vehicle aperture occurs when a predetermined level of drowsiness is monitored.

5. A method to alert driver comprising the steps of:

monitoring level of drowsiness; and pumping an amount of oxygen into a vehicle cab in response to an increase in said level of said drowsiness, wherein a climate control system is utilized to pump said amount of oxygen.

* * * * *